US006705973B1

(12) United States Patent
Fon

(10) Patent No.: US 6,705,973 B1
(45) Date of Patent: Mar. 16, 2004

(54) DISPLAY FOR EXERCISE DEVICES

(76) Inventor: Su-Jung Fon, 18F-1, No. 199, Sec. 1, Taichung-Kang Rd., West Dist., Taichung (TW)

( * ) Notice: Subject to any disclaimer, the term of this patent is extended or adjusted under 35 U.S.C. 154(b) by 0 days.

(21) Appl. No.: 10/335,799

(22) Filed: Jan. 2, 2003

(51) Int. Cl.[7] ..... A63B 21/00; A63B 21/02

(52) U.S. Cl. ..... 482/8; 482/909; 482/902; D21/696

(58) Field of Search ..... 482/1–10, 51, 482/54, 909, 900–902, 57; D21/696; 600/509, 519

(56) References Cited

U.S. PATENT DOCUMENTS 4,976,435 A * 12/1990 Shatford et al. ..... 463/36
5,888,172 A * 3/1999 Andrus et al. ..... 482/7
D456,054 S * 4/2002 Hicks ..... D21/736

* cited by examiner

*Primary Examiner*—Stephen R. Crow
(74) *Attorney, Agent, or Firm*—Alan Kamrath

(57) ABSTRACT

A display for exercise devices includes a holder, a display body, resilient members, two damper assemblies and a lock assembly. The holder has an open top and a central cavity. The display body has a bottom and is movably mounted in the central cavity of the holder with the resilient members and the damper assembly. When the display body moves downward in the central cavity and compresses the resilient members, the lock assembly mounted in the holder near the bottom of the holder locks the display body in position. When the lock assembly unlocks the display body, restitution forces in the resilient members push the display body smoothly out of the central cavity by means of the damper assemblies damping the speed of the display body.

11 Claims, 8 Drawing Sheets

DISPLAY FOR EXERCISE DEVICES

BACKGROUND OF THE INVENTION

1. Field of the Invention

The present invention relates to a display, and more particularly to a display suitable for retractably mounting on an exercise device.

2. Description of Related Art

People should do a physical activity such as walking or running to stay healthy and make the body stronger. In modern society, people in cities are always busy in business and at work. Therefore, many people in cities spend time in gyms and health clubs to exercise. There are many types of exercising devices such as stationary bicycles, treadmills or cross-country trainers in gyms and health clubs, and many of them have a display to show the speed, the settings, time, etc.

Generally, the display is mounted at a top of an exercise device in front of a user who is using the exercise device. A conventional display for the exercise device has a fixed volume and occupies a large space. The configuration of the conventional display attached to the exercise device is inconvenient for manufacturers to pack and transport. Today, the conventional display and the exercise device are packed individually by manufactures in the factory and delivered to consumers. The conventional display and exercise device are unpacked, and the consumer needs to attach the display to the exercise with fasteners and tools. Attaching the display to the exercise device is inconvenient.

If the exercise device is not a single mode device, the conventional display always has a display panel and pushbuttons to show messages and set the speed, time and settings. The display panel and the pushbuttons of the conventional display are exposed in the ambient environment. Sweat, dust or other contaminants may drop on the display panel or the pushbuttons and cause unexpected damage.

To overcome the shortcomings, the present invention provides a retractable display for exercise devices to mitigate or obviate the aforementioned problems.

SUMMARY OF THE INVENTION

A retractable display for exercise devices includes a holder, a display body, resilient members, two damper assemblies and a lock assembly. The holder has a top and a bottom, and a central cavity is defined through the top of the holder. The display body with a bottom is movably mounted in the central cavity of the holder with the resilient members and the damper assembly. The resilient members are mounted between the bottom of the display body and the holder in the central cavity. The lock assembly is mounted in the holder near the bottom of the holder and is adapted to lock the display body to maintain the display body in the central cavity at a lower position. Each damper assembly is mounted between the display body and the holder in the central cavity.

As the display body moves inward, the display body will compress the resilient members and create a restitution force. The lock assembly holds the display body in the lower position. To operate the device, the user pushes the lock assembly to unlock the display body, and the restitution force pushes the display body out of the central cavity. The damper assemblies provide a damper function to limit the speed of the display body such that the display body moves smoothly out of the central cavity. Therefor, the display body is normally held in the holder to prevent contaminants from entering the holder and smoothly moves out of the holder when the display is to be used.

The main objective of the invention is to provide a display for exercise devices that is retractable to reduce the space the display occupies such that packaging is convenient.

Another objective of the invention is to provide a retractable display for exercise devices to keep the display away from the contaminants such as sweat and dust.

Other objectives, advantages and novel features of the invention will become more apparent from the following detailed description when taken in conjunction with the accompanying drawings.

DETAILED DESCRIPTION OF PREFERRED EMBODIMENT

Figure 1:
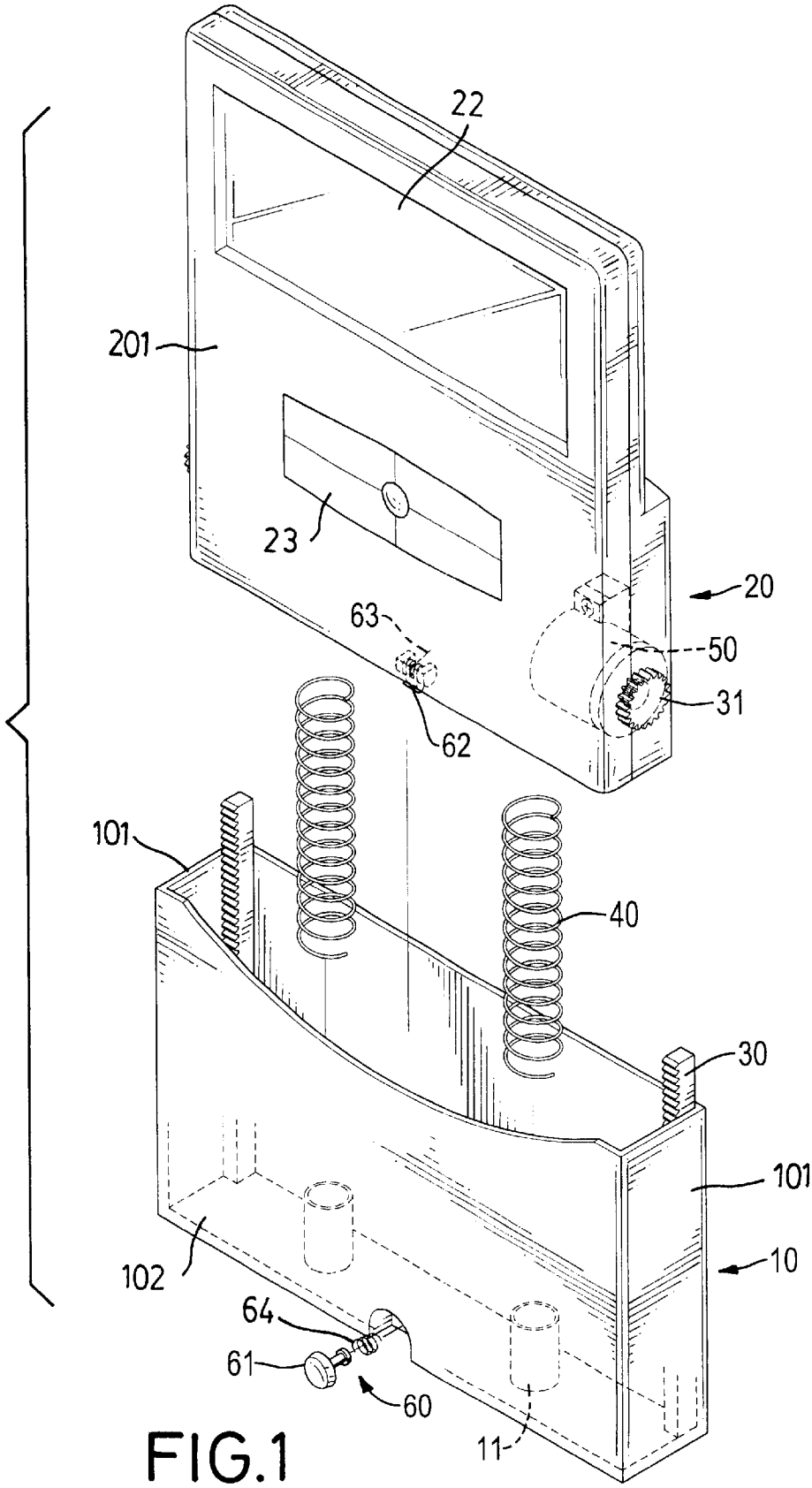
FIG. 1 is an exploded perspective view of a display for an exercise device in accordance with the present invention.
Figure 2:
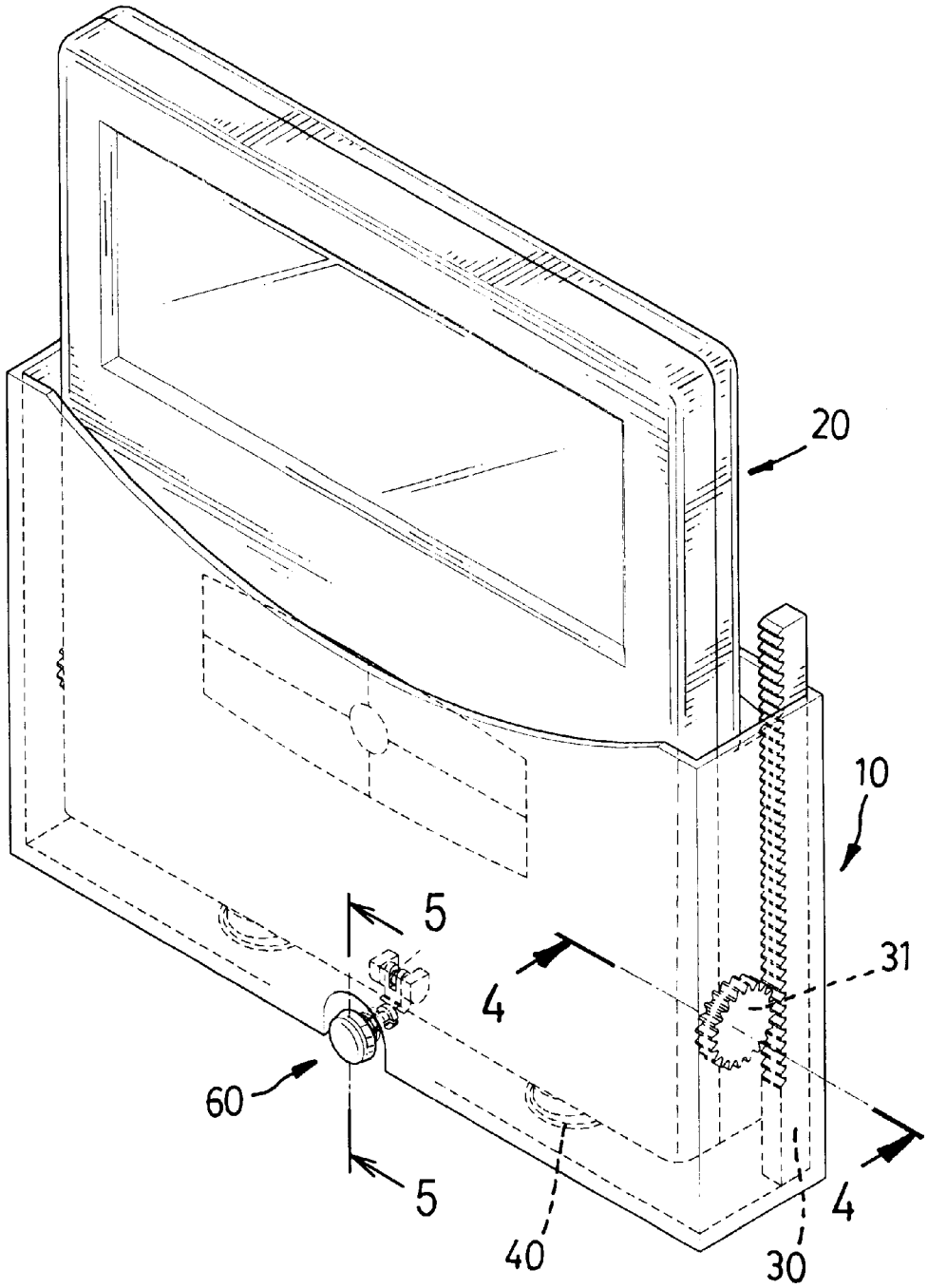
FIG. 2 is a perspective view of the display in FIG. 1 with the display retracted to reduce the volume.
Figure 5:
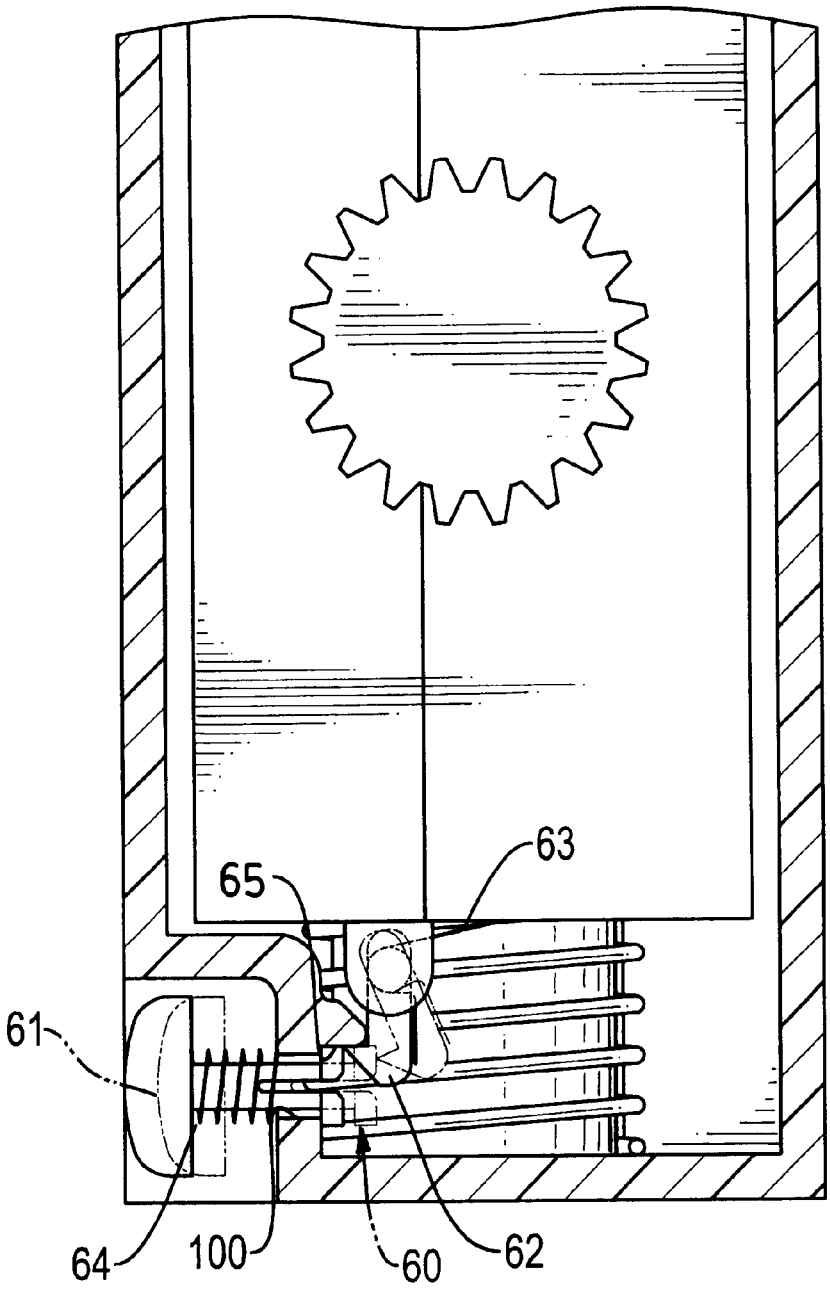
FIG. 5 is an enlarged side plan view in partial section of the display along line 5—5 in FIG. 2.

With reference to FIGS. 1, 2 and 5, a display for exercise devices in accordance with the present invention comprises a holder (10), a display body (20), a damper assembly (not numbered), resilient members (40) and a lock assembly (60).

The holder (10) is adapted to attach to an exercise device and has an open top (not numbered), a bottom (not numbered), a front (102), a rear (not numbered), two opposite sides (101) and a central cavity (not numbered). The bottom, the front (102), the rear and the two opposite sides have an inner surface (not numbered). Two positioning stubs (11) are formed integrally in the central cavity on the inner surface of the bottom of the holder (10). A through hole (100) is defined through the front of the holder (10) near the bottom and communicates with the central cavity in the holder (10).

The display body (20) is movably mounted in the central cavity in the holder (10) with the resilient members (40) and the damper assembly. The display body (20) has a front (201), a bottom (not numbered), and two sides (not numbered) respectively corresponding to the opposite sides of the holder (10). A display panel (22) is mounted in the front (201) of the display body (20) and is used to show messages. A controlling device (not numbered) to control the modes of operation and set settings is formed on the front (201) of the display body (20). The controlling device to control the modes of operation and set settings may be a touch screen implemented in the display panel (22), pushbuttons (23) attached to the front (201) of the display body (20), etc.

Figure 4:
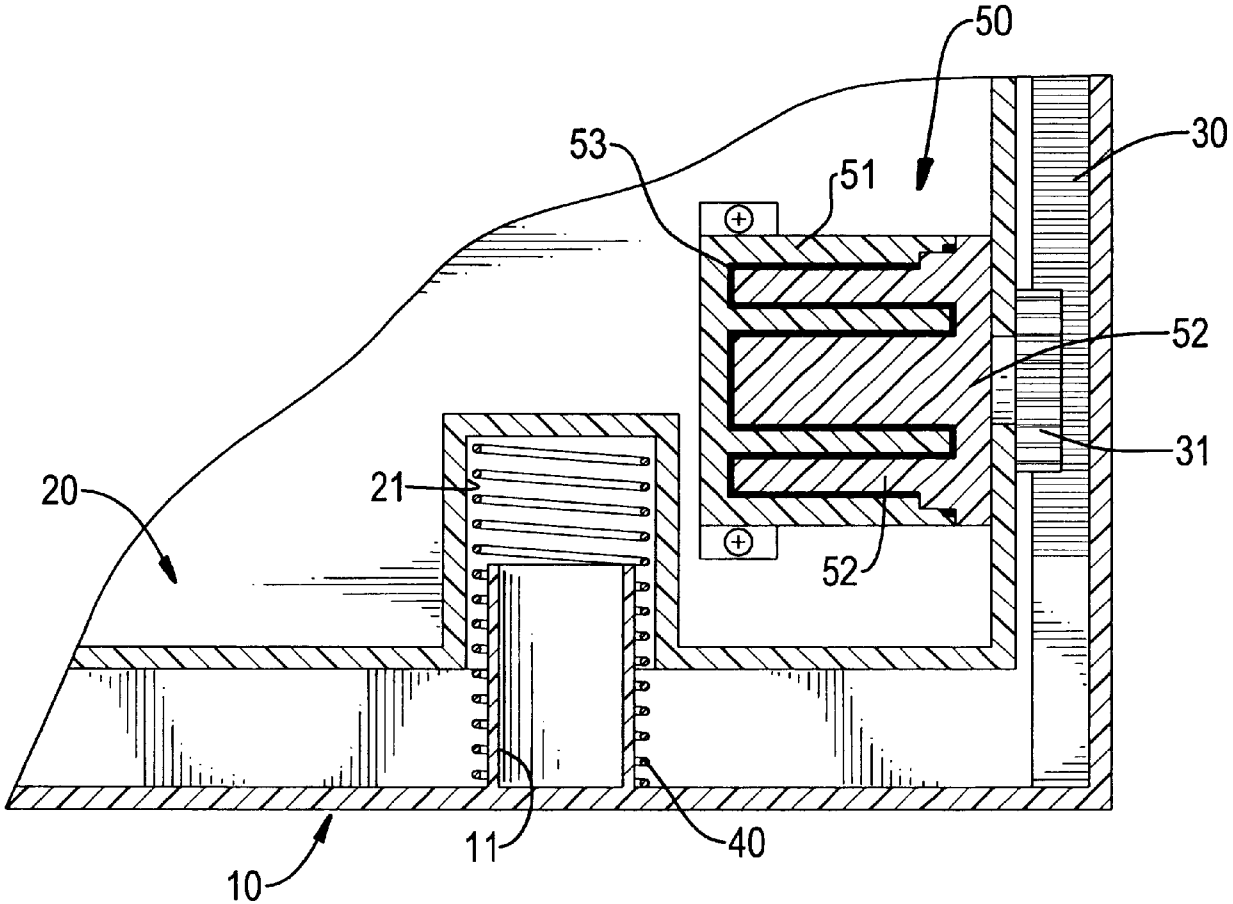
FIG. 4 is an enlarged, cross sectional front plan view of the display along line 4—4 in FIG. 2.

With reference to FIGS. 1 and 4, two positioning holes (21) corresponding to the positioning stubs (11) in the central cavity of the holder (10) are defined in the bottom of the display body (20). The positioning stubs (11) respectively are movably mounted in the positioning holes (21) in the display body (20) with the resilient members (40) such that the display body (20) only can move upward or downward in the central cavity of the holder (10). The resilient members (40) can be compressible springs, rubber bumpers or the like and each has a top end (not numbered) and a bottom end (not numbered). The bottom end of the resilient member (40) is attached to and around the positioning stub (11), and the top end of the resilient member (40) is attached to and in the positioning hole (21). Consequently, when the display body (20) is pressed to a lower position in the central cavity, the resilient member (40) is compressed thereby creating a restitution force that can push the display body (20) upward in the central cavity of the holder (10).

Two damper assemblies are mounted in the display body (20) and the holder (10) to limit how fast the display body (20) will move relative to the holder (10). Each damper assembly is comprised of a rack (30), a spur gear (31) and a damper (50). The racks (30) respectively are attached to the inner surface at opposite edges of the rear of the holder (10). The spur gear (31) engages the rack (30) and is attached to the damper (50). The damper (50) includes a stator (51), a rotor (52) and an oil film (53). The stator (51) is mounted in the display body (20) corresponding to the rack (30), and the rotor (52) with a shaft (not numbered) is rotatably mounted in the stator (52). The shaft of the rotor (52) extends out of the display body (20), and the spur gear (31) is attached to the shaft. High viscosity oil is filled between the stator (51) and the rotor (52) to form the oil film (53) that limits the rotary speed of the rotor (52).

Figure 3:
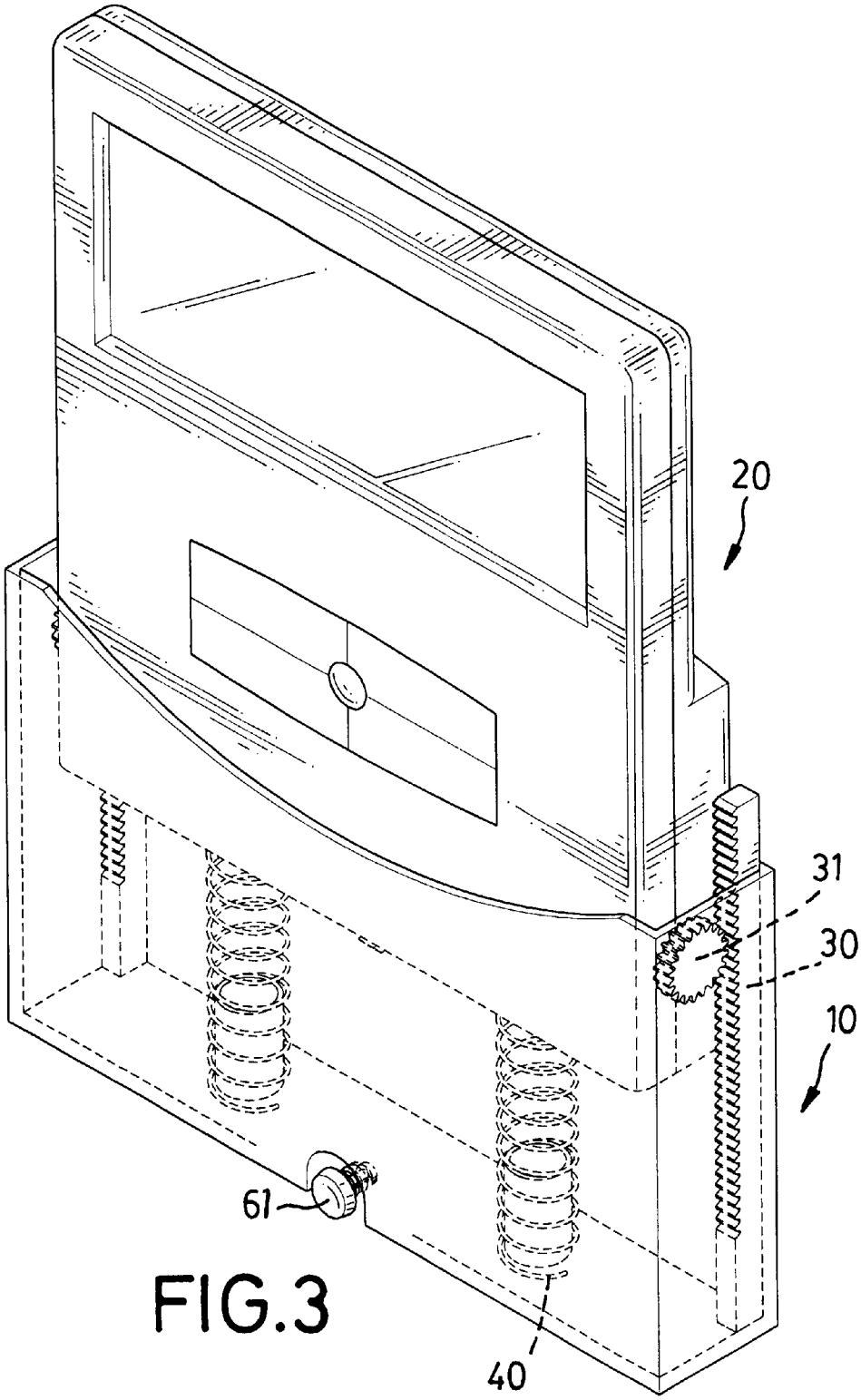
FIG. 3 is a perspective view of the display in FIG. 1 with the display in use.

With reference to FIGS. 3 and 5, the lock assembly (60) is used to lock the display body (20) at the lower position in the central cavity of the holder (10). The lock assembly (60) includes a release (61), a pawl (62), a torsion spring (63), a spring (64) and a latch (65). The release (61) is movably mounted in the through hole (100) in the front (102) of the holder (10) and has an enlarged head (not numbered) and a releasing end (not numbered). The releasing end of the release (61) passes through the through hole (100) and stays in the central cavity. The spring (64) is mounted around the release (61) between the enlarged head and front (102) of the holder (10). The pawl (62) is pivotally mounted on the bottom of the display body (20) corresponding to the release (61). The torsion spring (63) pivots the pawl (62) toward the release (61). The latch (65) protrudes from the inner surface of the front (102) of the holder (10) over the release (61) and is engaged by the pawl (62) as the display body (20) moves into the lower position.

With reference to FIGS. 3 to 5, the releasing end of the release (61) presses against and disengages the pawl (62) from the latch (65) when a user pushes the enlarged head of the release (61) toward the central cavity. The restitution force in the resilient members (40) moves the display body (20) upward. The movement of the display body (20) rotates the spur gear (31). Because the oil film is highly viscous and the rotor (52) is coupled to the spur gear (31), the rotary speed of the spur gear (31) is damped and limited by the rotor (52). Therefor, the display body (20) will move upward slowly and smoothly to keep the display body (20) from popping out of the holder (10).

Figure 6:
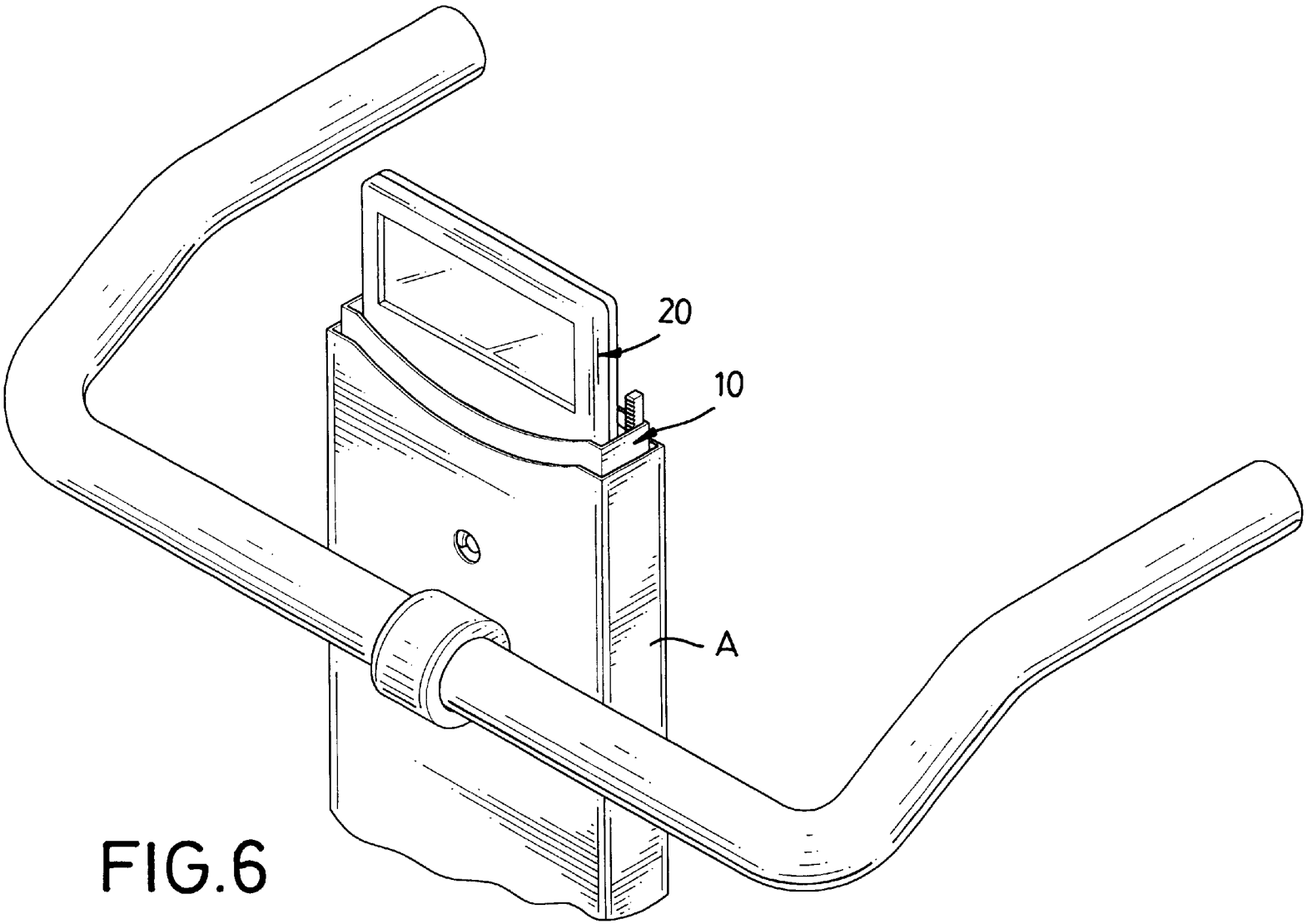
FIG. 6 is an operational perspective view of the display in FIG. 1 attached to handlebars.

With reference to FIG. 6, the display is mounted in a support (A) on the exercise device. The support (A) has a central cavity (not numbered) with an open top, which is fabricated in the factory to receive the display. The user only needs to insert the display into the top of the central cavity of the support (A), and this is very convenient.

Figure 7:
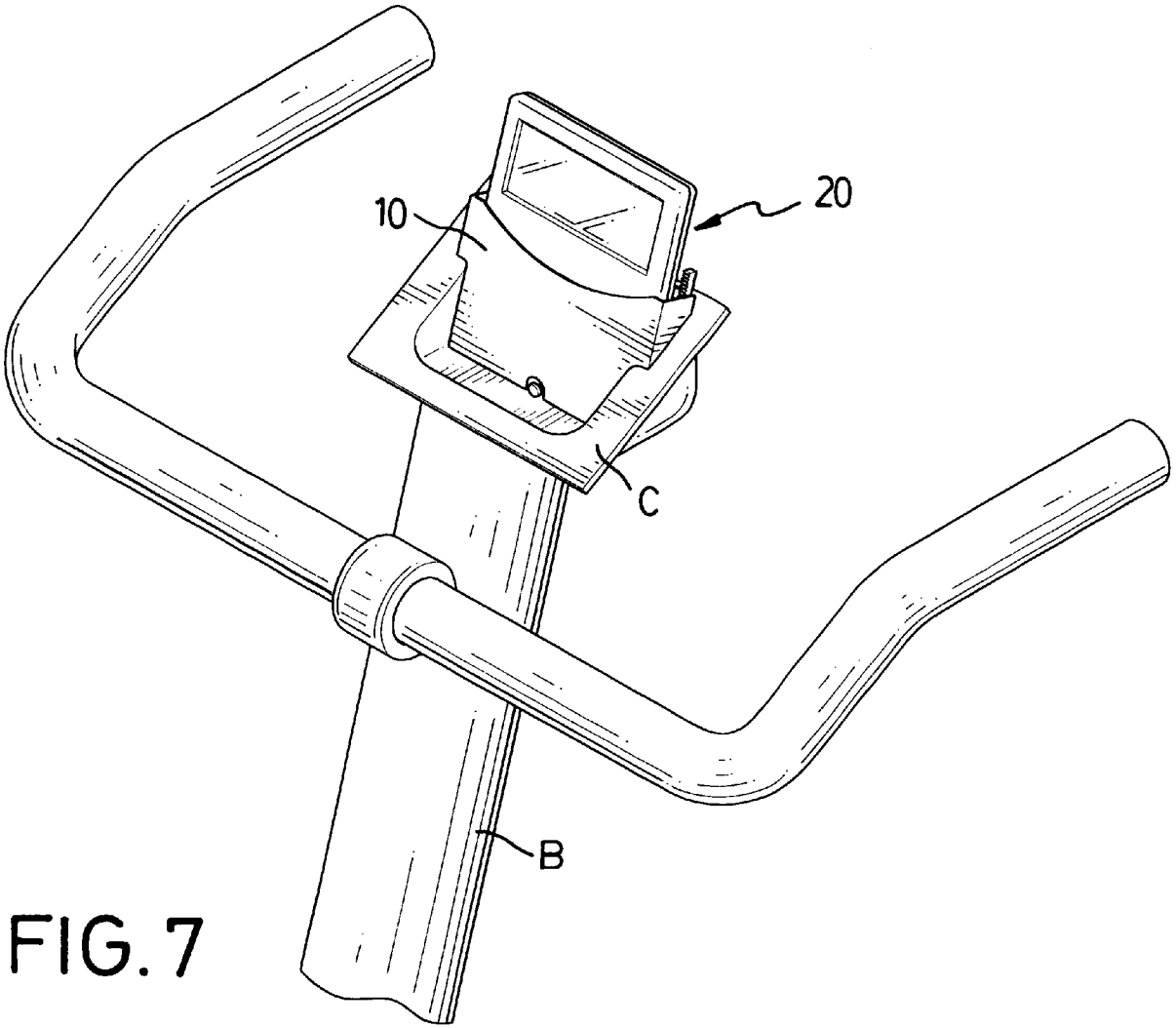
FIG. 7 is another operational perspective view of the display in FIG. 1 attached to handlebars.

With reference to FIG. 7, another application of the display installs the display in a top seat (C) on a support (B) of the exercise device. The display body (20) is pressed into the holder (10) to keep it away from contaminants.

Figure 8:
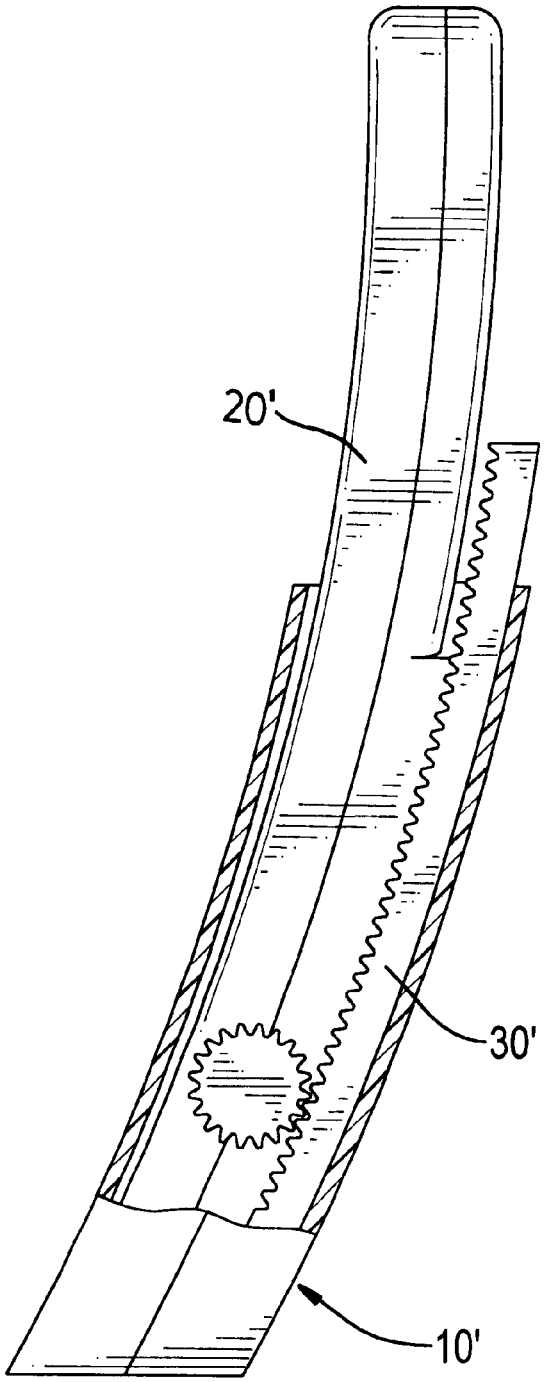
FIG. 8 is a side plan view in partial section of an alternate embodiment of the display in accordance with the present invention.

With reference to FIG. 8, another embodiment of the holder (10') and the display body (20') has a stream-line, curved shape to accommodate requirements of consumers. The racks (30') are also curved to correspond to the display body (20').

Furthermore, the display body (20) can be designed to totally receive in the holder (10). This kind of design not only saves storage space for the display but also keeps the display panel (22) and pushbuttons (23) from exposure to dust, sweat or other contaminants.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A display for a exercise device and the display comprising:

a holder adapted to attach to an exercise device and the holder having
- an open top,
- a bottom with an inner surface,
- a front with an inner surface,
- a rear with an inner surface,
- two opposite sides with an inner surface,
- a central cavity, and
- a through hole defined through the holder near the bottom of the holder and communicating with the central cavity;

a display body with a front and a bottom movably mounted in the central cavity of the holder, and the display body having
- a display panel mounted in the front of the display body and adapted to show messages; and
- a controlling device mounted on the front of the display body and adapted to control modes of operation and set settings of the display body;

at least one resilient member with a top end and a bottom end mounted between the holder and the bottom of the display body in the central cavity and adapted to provide a restitution force for moving the display body upward in the central cavity;

a damper assembly mounted between the display body and the holder in the central cavity and adapted to limit how quickly the display body moves; and a lock assembly attached to the holder and adapted to hold the display body in the central cavity of the holder at a lower position and the lock assembly comprising
- a release with an enlarged head and a releasing end movably mounted in the through hole, and the releasing end in the central cavity;
- a pawl pivotally mounted on the bottom of the display body corresponding to the release; and
- a latch formed on the holder in the central cavity over the release;

wherein the pawl engages the latch to keep the display body at the lower position in the central cavity of the holder.

2. The display as claimed in claim 1, wherein the damper assembly comprises a rack attached to the inner surface of the rear at each opposite edge of the holder;

a spur gear rotatably attached to each opposite side of the holder and engaging with a corresponding one of the racks;

a stator mounted in the display body and corresponding to each spur gear;

a rotor with a shaft rotatably mounted in each stator, and the shaft of the rotor extending out of the display body to attach to a corresponding one of the spur gears; and a high viscosity oil film formed between each stator and each rotor.

3. The display as claimed in claim 1, wherein a positioning stub is formed in the central cavity on the inner surface of the bottom of the holder and corresponds to the bottom end of each at least one resilient member for the bottom of the corresponding at least on resilient member mounting around the positioning stub;

a positioning hole corresponding to each respective positioning stub is defined in the bottom of the display body for receiving the top end of the corresponding one of the at least one resilient member.

4. The display as claimed in claim 2, wherein a positioning stub is formed in the central cavity on the inner surface of the bottom of the holder and corresponds to the bottom end of each at least one resilient member for the bottom of the corresponding at least on resilient member mounting around the positioning stub;

a positioning hole corresponding to each respective positioning stub is defined in the bottom of the display body for receiving the top end of the corresponding one of the at least one resilient member.

5. The display as claimed in claim 1, wherein the lock assembly further comprises a torsion spring attached to the bottom of the display body and adapted to pivot the pawl toward the latch; and a spring mounted around the release between the enlarged head of the release and the holder.

6. The display as claimed in claim 5, wherein the at least one resilient member is a compressed spring.

7. The display as claimed in claim 4, wherein the lock assembly further comprises a torsion spring attached to the bottom of the display body and adapted to pivot the pawl toward the latch; and a spring mounted around the release between the enlarged head of the release and the holder.

8. The display as claimed in claim 7, wherein the at least one resilient member is a compressible spring.

9. The display as claimed in claim 6, wherein the through hole is defined through the front of the holder, and the latch is formed on the inner surface of the front in the central cavity over the release.

10. The display as claimed in claim 8, wherein the through hole is defined through the front of the holder, and the latch is formed on the inner surface of the front in the central cavity over the release.

11. The display as claimed in claim 1, wherein the controlling device is pushbuttons attached to the front of the display body.

* * * * *